US012523442B2

(12) United States Patent
Afshari

(10) Patent No.: US 12,523,442 B2
(45) Date of Patent: Jan. 13, 2026

(54) RIFLE WITH TAPERED INTERFACES

(71) Applicant: 03312004 LLC, Chandler, AZ (US)

(72) Inventor: Thomas Afshari, Chandler, AZ (US)

(73) Assignee: 03312004 LLC, Chandler, AZ (US)

( * ) Notice: Subject to any disclaimer, the term of this patent is extended or adjusted under 35 U.S.C. 154(b) by 64 days.

(21) Appl. No.: 18/544,736

(22) Filed: Dec. 19, 2023

(65) Prior Publication Data

US 2024/0151486 A1 May 9, 2024

Related U.S. Application Data

(63) Continuation-in-part of application No. 17/662,994, filed on May 11, 2022, now abandoned.

(60) Provisional application No. 63/436,895, filed on Jan. 4, 2023, provisional application No. 63/265,701, filed on Dec. 20, 2021.

(51) Int. Cl.
*F41A 21/48* (2006.01)

(52) U.S. Cl.
CPC ..... *F41A 21/482* (2013.01)

(58) Field of Classification Search
CPC ..... F41A 21/48–487
USPC ..... 42/75.02
See application file for complete search history.

(56) References Cited

U.S. PATENT DOCUMENTS 5,706,599 A * 1/1998 Knight ..... F41A 21/485 42/51
6,289,782 B1 * 9/2001 Watson, Jr. ..... F41F 1/08 89/37.04
10,066,891 B2 * 9/2018 Iwasawa ..... F41A 21/487
2012/0180358 A1 * 7/2012 Samson ..... F41C 23/16 42/71.01
2012/0216439 A1 * 8/2012 Barrett ..... F41A 3/26 42/75.02
2013/0291420 A1 * 11/2013 Aalto ..... F41A 21/482 42/75.02
2016/0010937 A1 * 1/2016 Bero ..... F41A 21/484 42/16
2016/0033226 A1 * 2/2016 Potter ..... F41A 3/30 42/76.01
2016/0054096 A1 * 2/2016 Dzwill ..... F41A 21/48 42/75.02
2019/0257615 A1 * 8/2019 Tubb ..... F41A 21/48
2020/0141682 A1 * 5/2020 McMillan ..... F41A 21/10
2024/0328739 A1 * 10/2024 Geissele ..... F41A 3/66

* cited by examiner

*Primary Examiner* — Troy Chambers
*Assistant Examiner* — Benjamin S Gomberg
(74) *Attorney, Agent, or Firm* — Bennet K. Langlotz; Langlotz Patent & Trademark Works, LLC

(57) ABSTRACT

A rifle with tapered interfaces has a receiver, a barrel extension connected to the receiver at a first interface, a barrel connected to the barrel extension at a second interface, a barrel nut element connected to the barrel extension at a third interface and to the barrel at a fourth interface, and at least two of the first, second, third, and fourth interfaces being tapered interfaces. The tapered interfaces may be stably tapered such that a wedging effect is generated. The barrel extension may have two tapered interfaces. The barrel extension may have a forward external tapered interface connecting to the barrel nut element and a forward internal tapered interface connecting to the barrel.

16 Claims, 19 Drawing Sheets

RIFLE WITH TAPERED INTERFACES

CLAIM OF DOMESTIC PRIORITY

The present application is a Continuation of U.S. application Ser. No. 17/662,994, filed May 11, 2022, which claims the benefit of U.S. Provisional Application No. 63/265,701, filed Dec. 20, 2021, which applications are incorporated herein by reference. The present application also claims the benefit of U.S. Provisional Application No. 63/436,895, filed Jan. 4, 2023, which application is incorporated herein by reference.

FIELD OF THE INVENTION

The present invention relates to firearms, and more particularly to a rifle with tapered interfaces that enables the barrel of a rifle to remained centered relative to the receiver bore during thermal expansion of the rifle's components.

BACKGROUND

Modern firearms are designed and manufactured to operate with multiple inter-operational components and often with modular construction. In one example, an AR-10 or AR-15 style sporting rifle 100 uses a modular construction with an upper receiver 102 and lower receiver 104, as shown in FIG. 1*a*. Lower receiver 104 is characterized by trigger guard 106, trigger assembly 108, pistol grip 110, and magazine well 112. Buttstock 114 attaches to lower receiver 104.

Upper receiver 102 is characterized by bolt carrier assembly, forward assist, charging handle, and gas-operated reloader. Ejector 118 provides for exit of spent cartridges from upper receiver 102. Barrel assembly 120 with handguard 122 attaches to upper receiver 102. Lower receiver 104 is attached to upper receiver 102 by removable rear take-down pin 124 and forward pivot pin 126. Removing rear take-down pin 124 allows upper receiver 102 to hinge and rotate about forward pivot pin 126, see FIG. 1*b*.

Barrel assembly 120 is typically secured to upper receiver 102 with a single barrel nut. The barrel nut torques the barrel to upper receiver 102. Unfortunately, the single barrel nut does not ensure, and generally does not provide, proper alignment between the bore of the barrel and the bore of upper receiver 102. Any misalignment between the bore of the barrel and the bore of upper receiver 102 can cause wear on the bolt, catastrophic failure of the bolt, and un-torquing of the barrel extension due to vibration and heat expansion. Moreover, even when the barrel is properly secured to the upper receiver via the barrel nut and barrel extension, the ignition of ammunition inside the barrel chamber still can cause the length of the barrel to move, i.e., "whip," due to harmonic vibration. The harmonic vibration decreases the reliability and accuracy of the barrel.

A standard barrel mounting system for the AR platform relies on flat torque shoulders to mount the barrel to the barrel extension, to fit the barrel extension to the upper receiver, and to secure the entire system onto the upper receiver via a singular barrel nut. These torque shoulders are typically not perfectly flat and exhibit high points and low points, even if only by a few thousandths of an inch. The effect of this is that upon installation, the barrel bore may not sit center with the upper receiver bore, and the barrel muzzle may lean away from the upper receiver axis. Any trauma to the barrel or handguard can then cause the barrel to further move away from center and alignment because of the lack of secure and even contact points. This degrades the rifle's accuracy. Moreover, the barrel, barrel extension, upper receiver, and barrel nut are all typically machined from different metals, each with their own thermal expansion rate. When the weapon is fired and its component materials heat up at different rates, the barrel deviations from center and alignment can be exacerbated. This further degrades the rifle's accuracy, particularly during prolonged shooting, and results in a need to frequently re-zero the weapon.

Manufacturers have attempted to solve this problem by a process known as shrink-fitting or thermal fitting, which is under-sizing the internal diameter of the upper receiver (i.e., machining it smaller) and over-sizing the outer diameter of the barrel extension (i.e., machining it larger) to the point where they will not fit together, and then using heat to force the installation. More specifically, the manufacturer will heat up (and consequently enlarge) the aluminum upper receiver, insert the steel or stainless-steel barrel extension, and then allow the upper receiver to cool and consequently contract around the barrel extension. The parts are then further secured by the barrel nut. The idea is that the thermal fit process is more rigid and secure than components torqued on flat shoulders, and the thermal fit process therefore makes the rifle more accurate both out of the box and over time.

The problem with the above approach is the same thermal forces that are used to shrink-fit or thermal fit the parts are present during the normal operation of the weapon. When the rifle is shot, the rifle heats up, and when the rifle heats up, the component parts will thermally expand, all at different rates, thereby negating the effect of the shrink-fit or thermal fit installation. Moreover, a shrink-fit or thermal fit process cannot guarantee bore centricity or axis alignment.

Therefore, a need exists for a new and improved rifle with tapered interfaces that enables the barrel of a rifle to remained centered relative to receiver bore during thermal expansion of the rifle's components. In this regard, the various embodiments of the present invention substantially fulfill at least some of these needs. In this respect, the rifle with tapered interfaces according to the present invention substantially departs from the conventional concepts and designs of the prior art, and in doing so provides an apparatus primarily developed for the purpose of enabling the barrel of a rifle to remained centered relative to receiver bore during thermal expansion of the rifle's components.

The present invention provides an improved rifle with tapered interfaces, and overcomes the above-mentioned disadvantages and drawbacks of the prior art. As such, the general purpose of the present invention, which will be described subsequently in greater detail, is to provide an improved rifle with tapered interfaces that has all the advantages of the prior art mentioned above.

To attain this, the preferred embodiment of the present invention essentially comprises a receiver, a barrel extension connected to the receiver at a first interface, a barrel connected to the barrel extension at a second interface, a barrel nut element connected to the barrel extension at a third interface and to the barrel at a fourth interface, and at least two of the first, second, third, and fourth interfaces being tapered interfaces. The tapered interfaces may be stably tapered such that a wedging effect is generated. The barrel extension may have two tapered interfaces. The barrel extension may have a forward external tapered interface connecting to the barrel nut element and a forward internal tapered interface connecting to the barrel. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

DETAILED DESCRIPTION OF THE DRAWINGS

The following describes one or more embodiments with reference to the figures, in which like numerals represent the same or similar elements. While the figures are described in terms of the best mode for achieving certain objectives, the description is intended to cover alternatives, modifications, and equivalents as may be included within the spirit and scope of the disclosure.

Figure 1A:
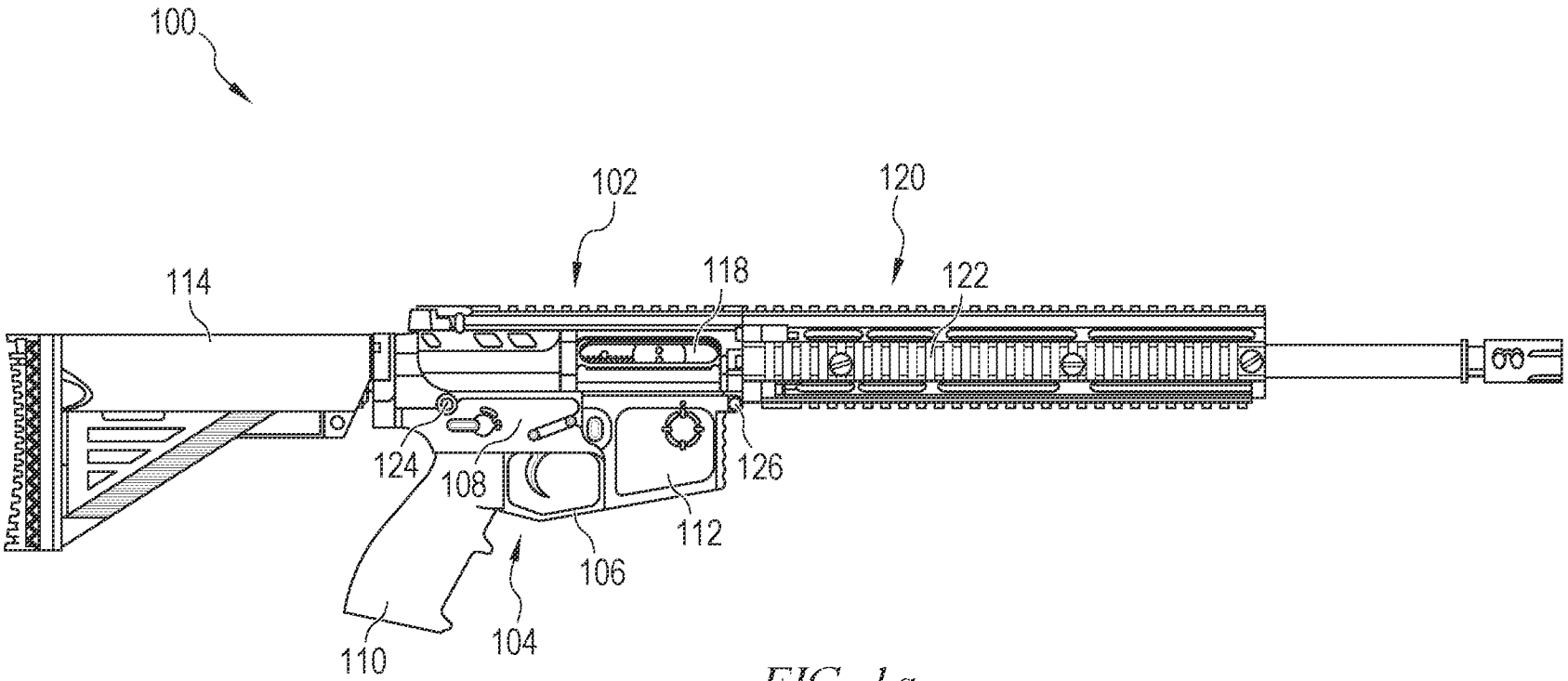
FIG. 1a (PRIOR ART)
FIGS. 1*a*-1*b* illustrate a sporting rifle with conventional upper receiver and lower receiver.
Figure 1B:
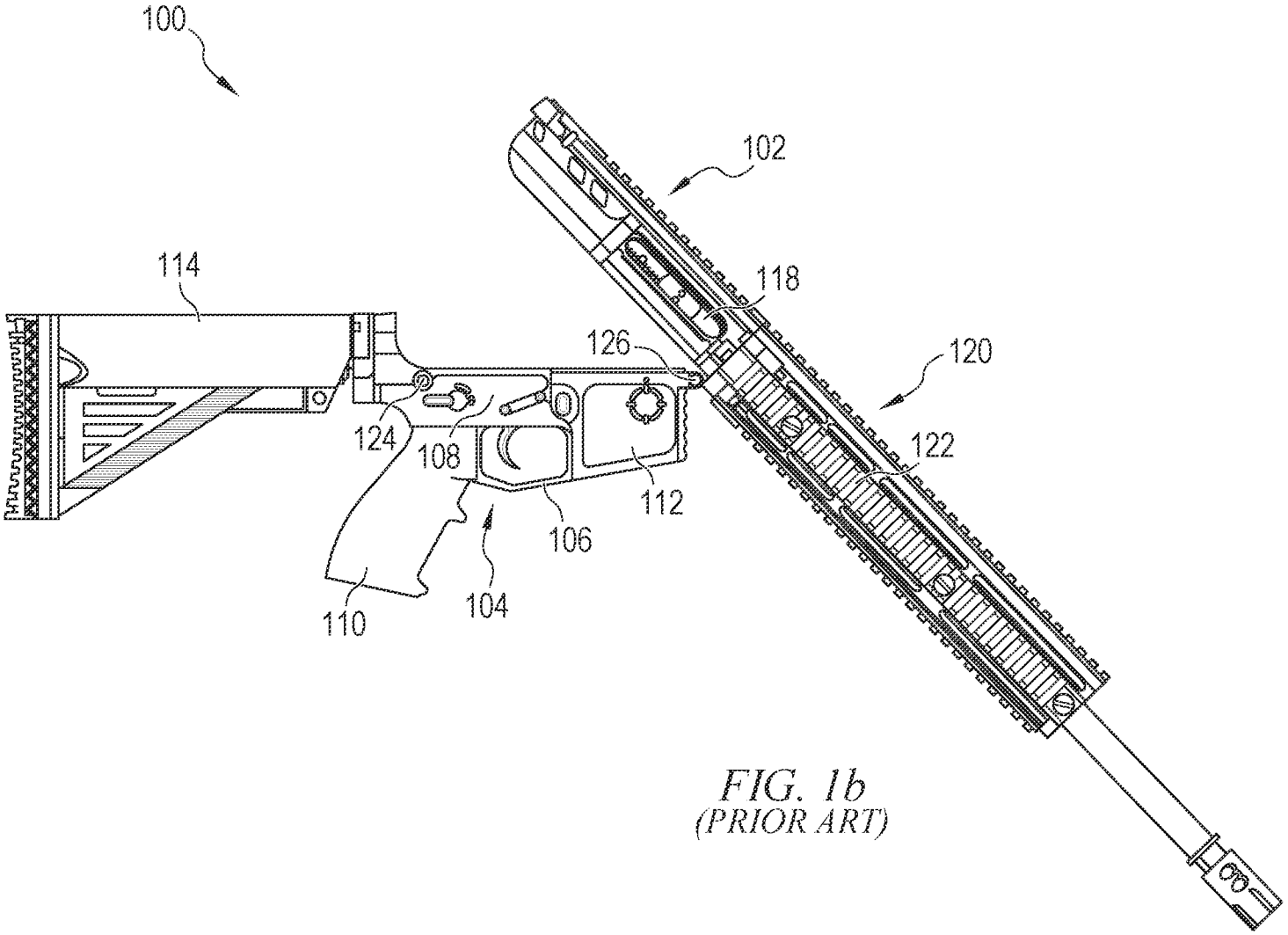
FIG. 1b (PRIOR ART)
Figure 2A:
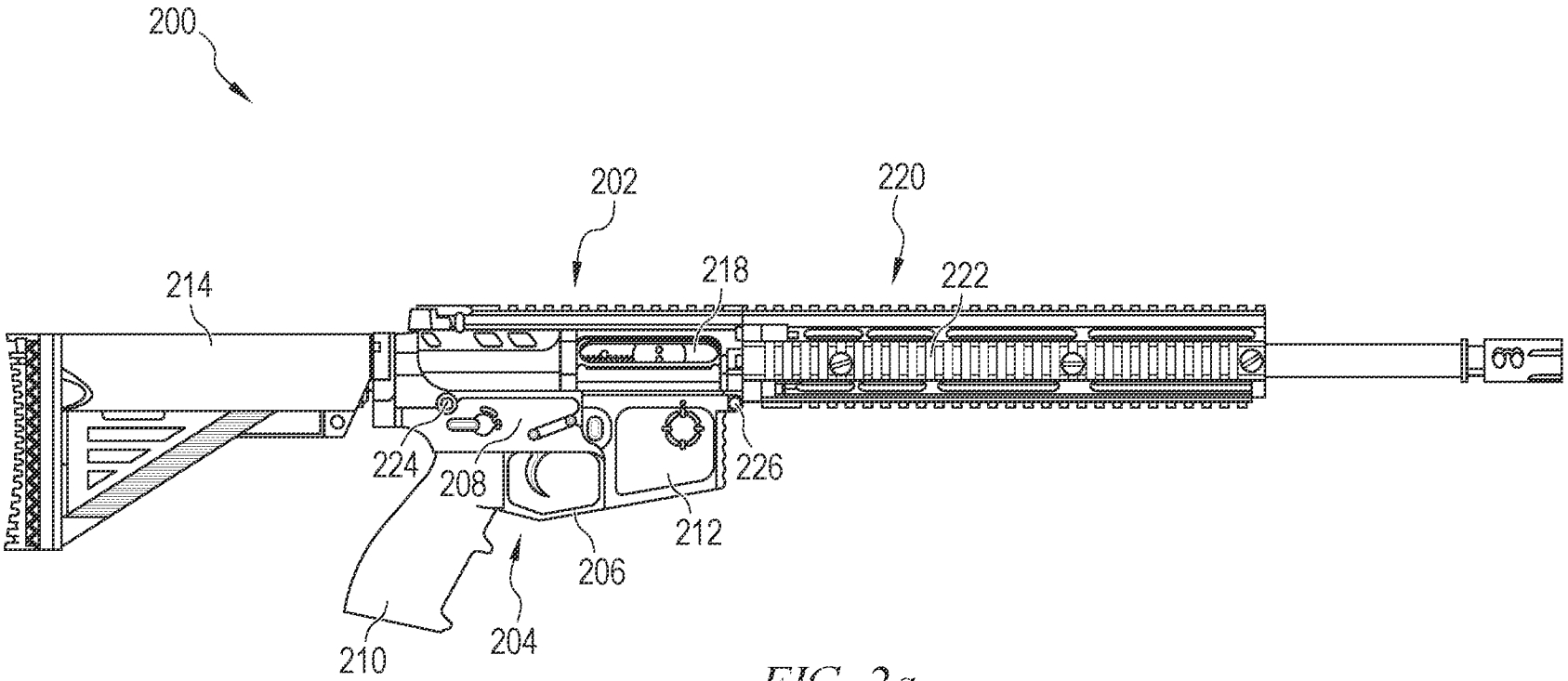
FIGS. 2*a*-2*b* illustrate a sporting rifle with an upper receiver, lower receiver, and double barrel nut assembly.

FIG. 2*a* shows an AR-10 or AR-15 style sporting rifle 200 designed for modular construction and manufactured for interchangeability of components. Sporting rifle 200 has upper receiver 202, typically forged or casted then computer numerical control (CNC) machined, and lower receiver 204, typically forged or casted then CNC machined. Lower receiver 204 includes trigger guard 206, trigger assembly 208, pistol grip 210, and magazine well 212. Buttstock 214 attaches to lower receiver 204.

Figure 2B:
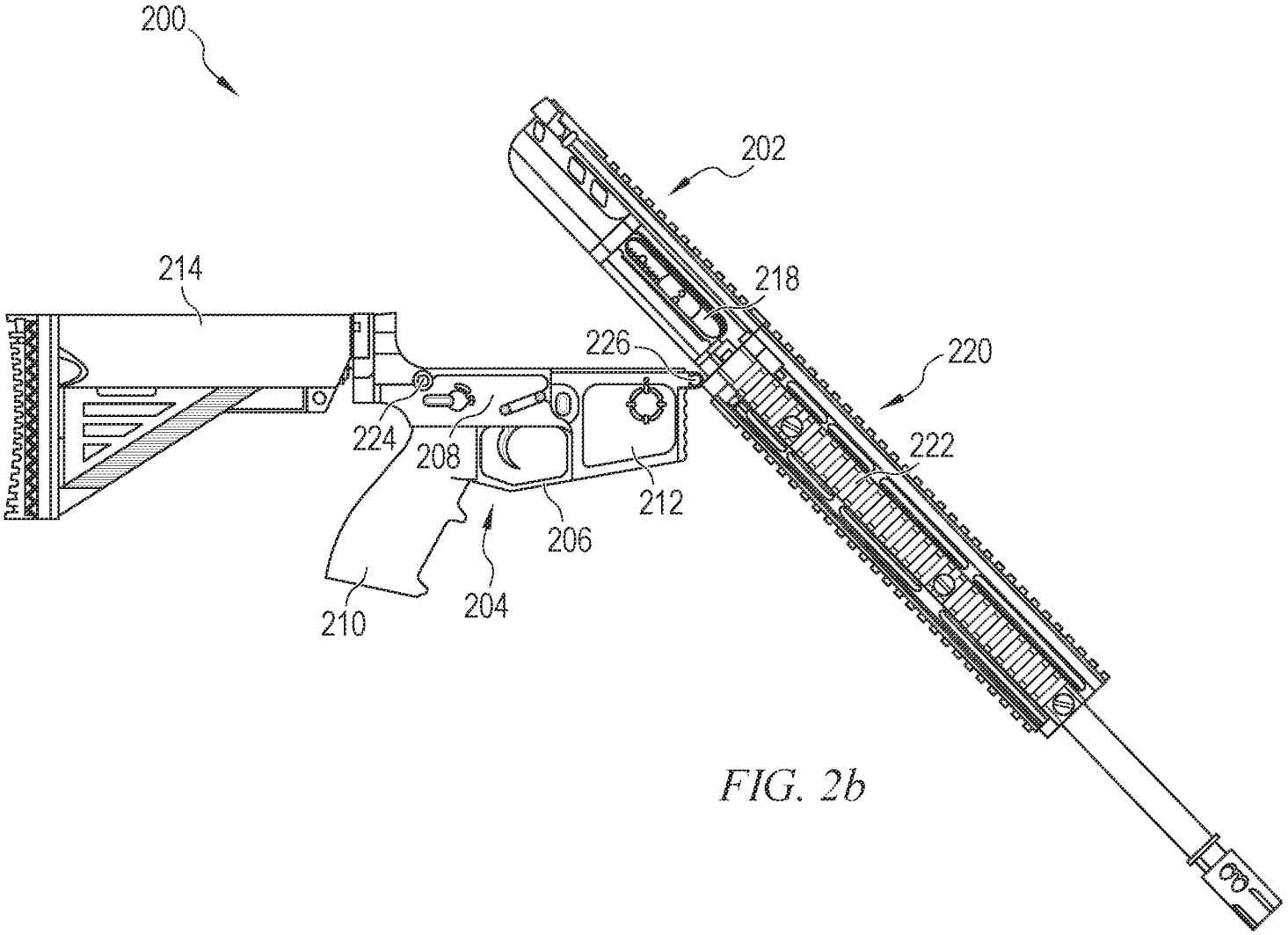

Upper receiver 202 includes bolt carrier assembly, forward assist, charging handle, and gas-operated reloader. Ejector 218 provides for exit of spent cartridges from upper receiver 202. Barrel assembly 220 with handguard 222 attaches to upper receiver 202. Lower receiver 204 is attached to upper receiver 202 by removable rear take-down pin 224 and forward pivot pin 226. Removing rear take-down pin 224 allows upper receiver 202 to hinge and rotate about forward pivot pin 226, see FIG. 2*b*. Removing forward take-down pin 226 from opening 228 allows upper receiver 202 to disconnect from lower receiver 204.

Figure 3A:
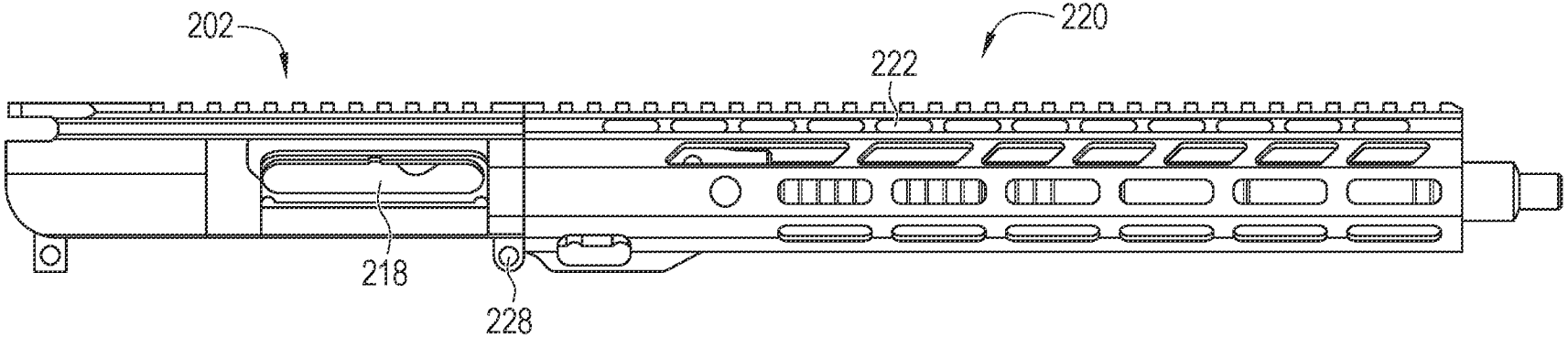
FIGS. 3*a*-3*b* illustrate the barrel assembly and barrel in isolation.
Figure 3B:
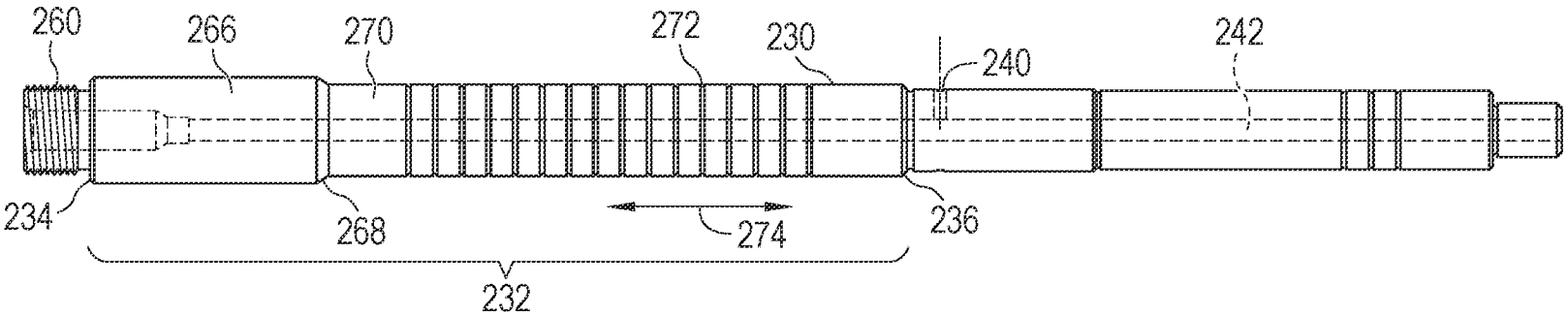

FIG. 3*a* shows upper receiver 202 and barrel assembly 220 in isolation, having been detached from lower receiver 204 by releasing rear take-down pin 224 and removing forward pivot pin 226 from opening 228. Elements having a similar function are assigned the same reference number in the figures. FIG. 3*b* shows inner-most barrel 230 stripped down from barrel assembly 220. Gas port 240 extends through barrel 230 to rifle bore 242. The location of the gas journal is modified for barrel reliability and performance optimization. Barrel 230 also includes beveled or tapered shoulder 268 extending between larger diameter surface 266 and smaller diameter surface 270. Expansion joints 272 cut or otherwise formed into smaller diameter surface 270.

Figure 4B:
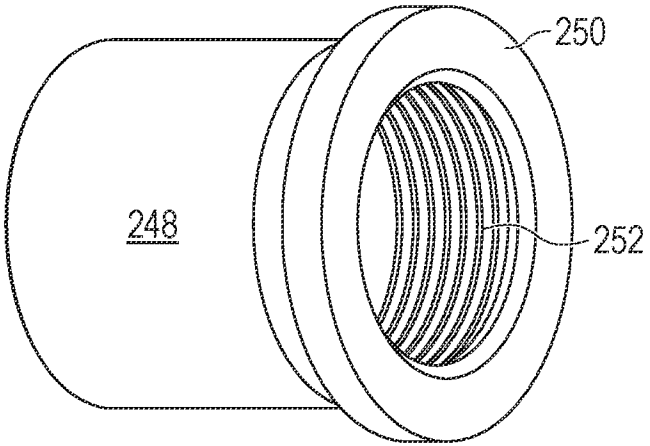
FIGS. 4*a*-4*g* illustrate a barrel extension mated to the barrel.
Figure 4D:
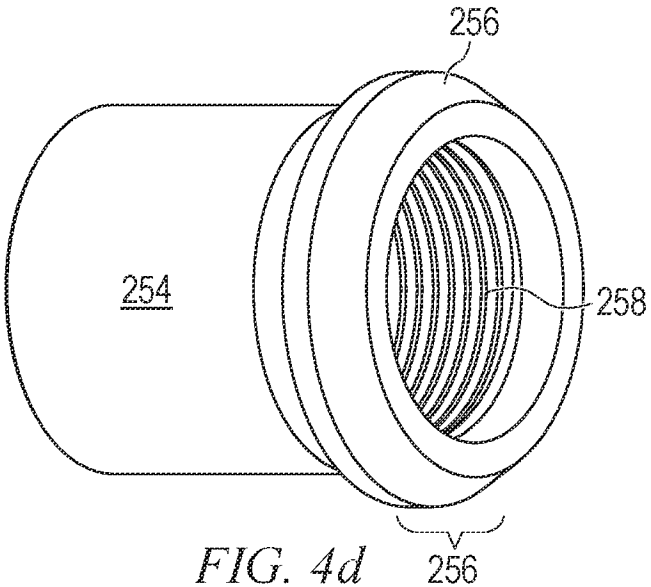
Figure 4A:
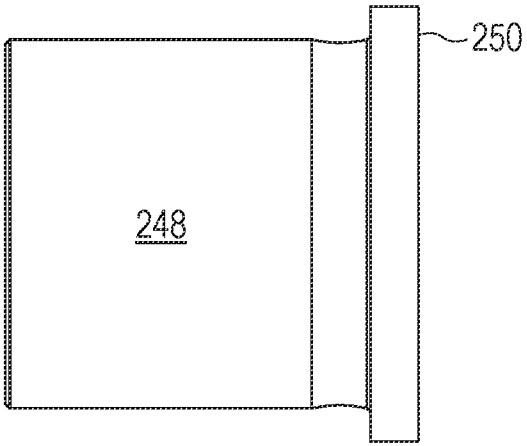
Figure 4C:
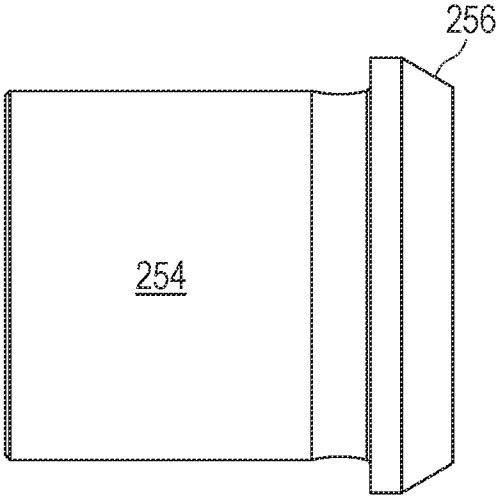

FIG. 4*a* shows barrel extension 248 with flat shoulder 250. FIG. 4*b* shows barrel extension 248 and flat shoulder 250 with internal female threading 252. In an alternate embodiment, FIG. 4*c* shows barrel extension 254 with beveled or tapered shoulder 256. FIG. 4*d* shows barrel extension 254 with beveled or tapered shoulder 256 and internal female threading 258. In one embodiment, beveled or taper shoulder portion 256 is formed with an angle of 10-60 degrees.

Figure 4E:
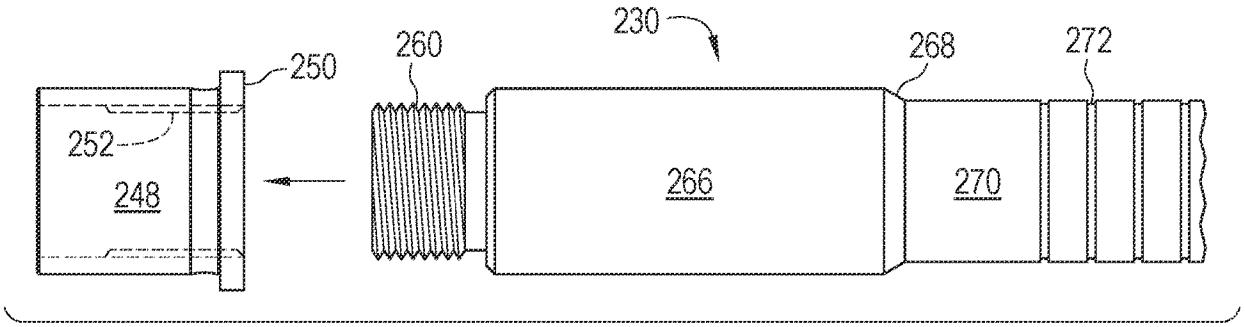
Figure 4F:
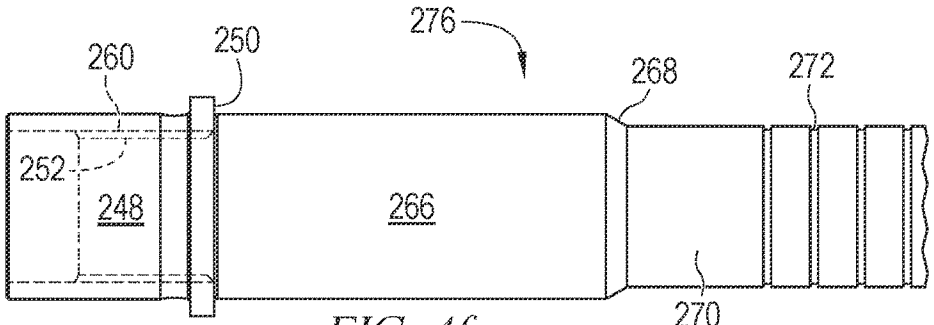
Figure 4G:
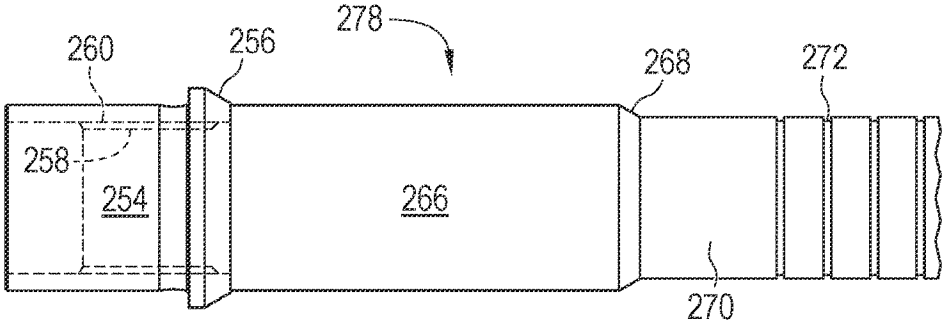

In FIG. 4*e*, barrel extension 248, leading with shoulder 250, is disposed adjacent to thread-end 260 of barrel 230, proximate to larger diameter surface 266. Threads 252 inside barrel extension 248 are screwed onto threaded-end 260. FIG. 4*f* shows barrel extension 248 threaded onto threaded-end 260 of barrel 230 and designated as barrel assembly 276. Alternatively, barrel extension 254 with beveled or tapered shoulder 256 and female threading 258 can be threaded onto threaded-end 260 of barrel 230 proximate to larger diameter surface 266, similar to FIG. 4*e*. FIG. 4*g* shows barrel extension 254 threaded onto threaded-end 260 of barrel 230 and designated as barrel assembly 278.

FIGS. 4*f*-4*g* further show beveled or tapered shoulder 268 extending between larger diameter surface 266 and smaller diameter surface 270. Expansion joints 272 cut or otherwise formed into smaller diameter surface 270. The ignition of ammunition inside the barrel chamber causes an extreme amount of heat and results in the increase in temperature of the barrel material. Barrel material, typically steel or stainless steel, expands in response to the heat. Material heat expansion follows the path of least resistance. In the case of barrels, this path is the rifling machined inside the barrel bore. The rifling will tend to cause the barrel to expand laterally in the presence of heat. Expansion joints 272 on the outside of barrel 230 disrupt the lateral barrel material warping caused by heat expansion. More specifically, expansion joints 272 cause expansion to occur linearly instead of laterally. Linear expansion is preferred as lateral expansion will decrease the accuracy of barrel 230. Accordingly, expansion joints 272 cause barrel 230 to expand and contract in the linear direction shown by arrow 274 in FIG. 3*b* upon heating while firing and then cooling. Expansion joints 272 prevent or reduce lateral movement of barrel 230.

Barrel assembly 276, 278 is mounted to upper receiver 202 using a two-stage or double independent taper-lock barrel nut assembly, as will be described in FIGS. 7*a*-7*f*. The two-stage or double independent taper-lock barrel nut assembly includes a first or primary barrel nut and a second or secondary barrel nut. FIG. 5*a* shows primary barrel nut 280 with a first primary barrel nut end 282 and second distal primary barrel nut end 284. Primary barrel nut 280 includes a plurality of openings 286 around a perimeter of the shaft and centrally located between primary barrel nut ends 282 and 284. Openings 286 provide leverage points to torque primary barrel nut 280. For example, primary barrel nut 280 can be tightened by inserting a tool, e.g., spanner wrench, into openings 286 to turn the primary barrel nut. Channels 288 can be formed in the shaft for ease of handling and assembly. Primary barrel nut 280 can be made from aluminum, steel, or titanium.

Figure 5B:
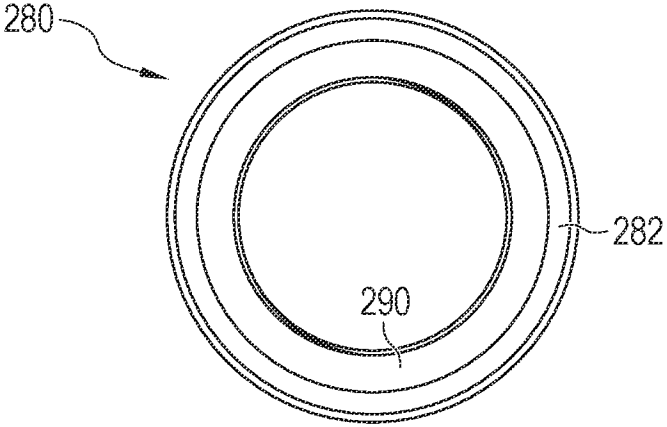
FIGS. 5*a*-5*e* illustrate various views of the primary barrel nut.
Figure 5A:
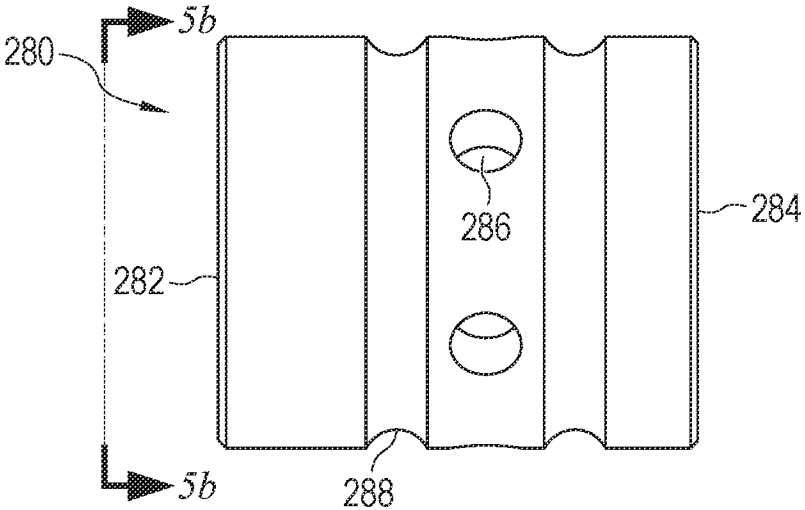

FIG. 5*b* shows internal arrangement of primary barrel nut 280, from primary barrel nut end 282, with female internal threading 296 and internal flat shoulder 290, which will later contact external flat shoulder 250 of barrel extension 248 upon further assembly. Threading 296 will mate with threading 320 on upper receiver 202. FIG. 5*c* illustrates a perspective view of the internal arrangement of primary barrel nut 280, from primary barrel nut end 282, with internal flat shoulder 290, which will later contact external shoulder 250 of barrel extension 248 upon further assembly.

Figure 5D:
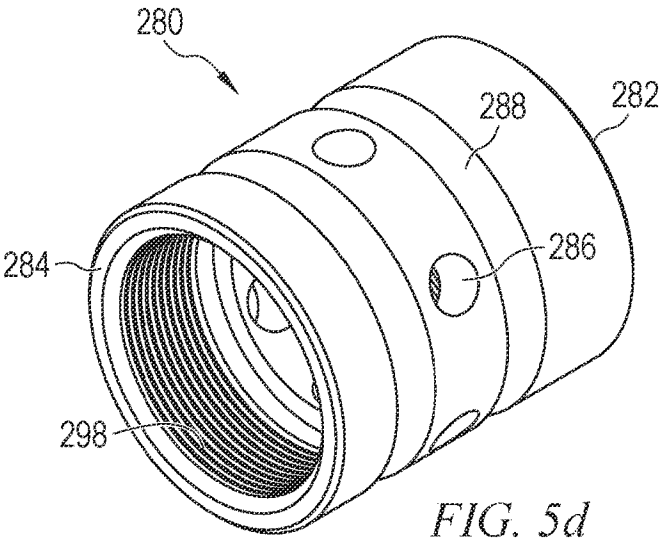
Figure 5C:
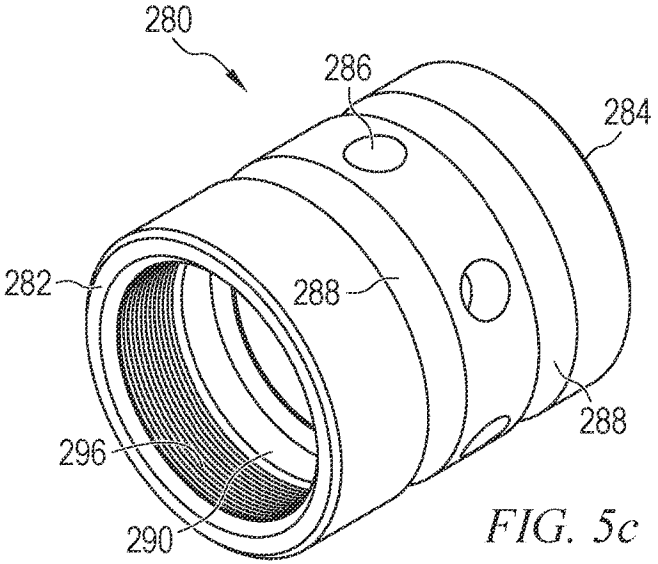

FIG. 5*d* shows a perspective view of primary barrel nut 280 from primary barrel nut end 284 with internal female threading 298 to mate with threading 312 on secondary barrel nut 300. In one embodiment, threading 296 and threading 298 are machined identical to the same size and tolerance.

Figure 5E:
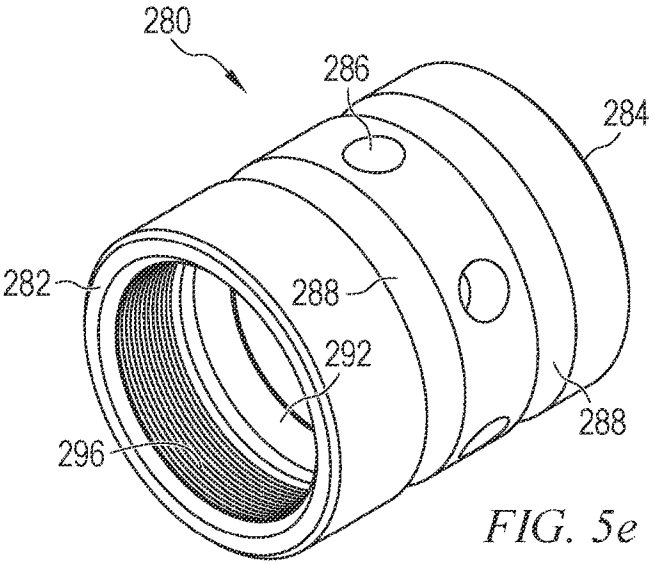

In accordance with the embodiment of FIGS. 4*c*-4*d*, FIG. 5*e* shows a perspective view of primary barrel nut 280 from primary barrel nut end 282 with internal female threading 296 and beveled or tapered shoulder 292, which will later contact external shoulder portion 256 of barrel extension 254 upon further assembly. Threading 296 will mate with threading 320 on upper receiver 202. Primary barrel nut end 284 has internal female threading 298, similar to FIG. 5*d*, to mate with threading 312 on secondary barrel nut 300.

Figure 6B:
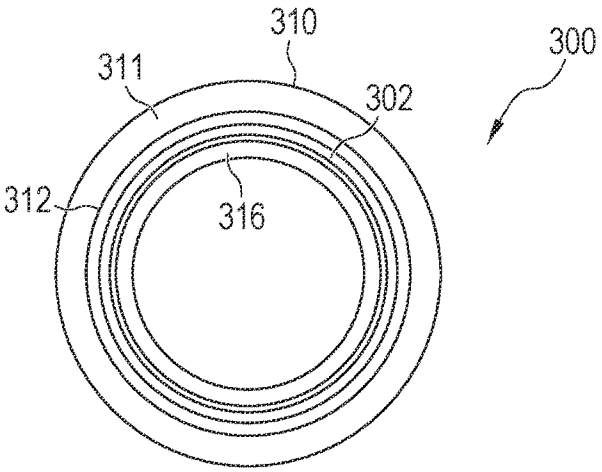
FIGS. 6*a*-6*d* illustrate various views of the secondary barrel nut.
Figure 6D:
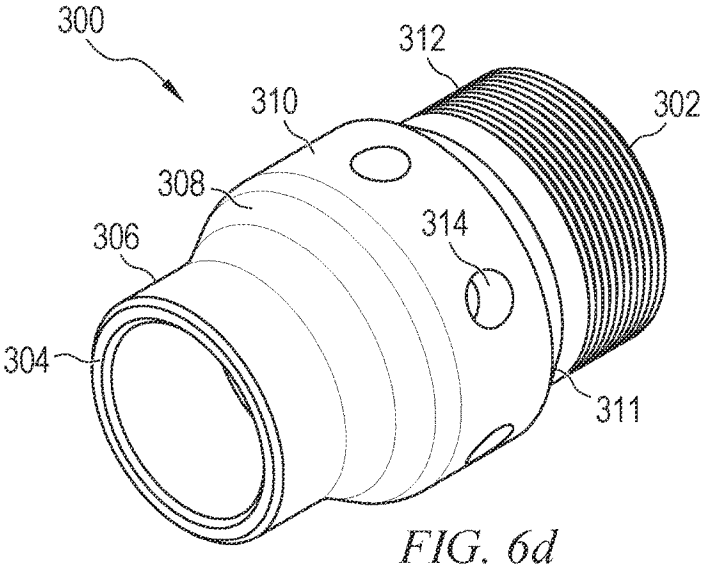
Figure 6A:
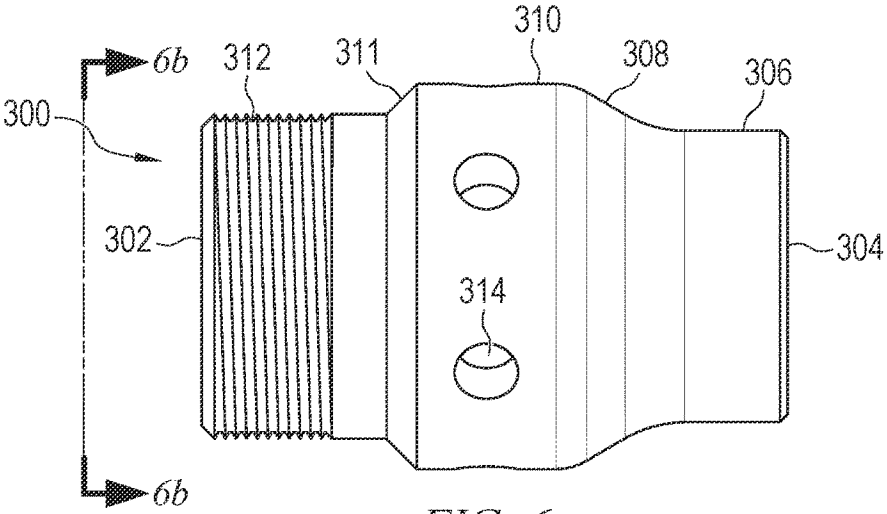

FIG. 6*a* shows secondary barrel nut 300 with a first secondary barrel nut end 302 and second distal secondary barrel nut end 304. Secondary barrel nut 280 includes a smaller diameter surface 306, first beveled or tapered surface 308, larger diameter surface 310, second beveled or tapered surface 311, external male threaded-end 312, and a plurality of openings 314 around a perimeter of the larger diameter surface. Openings 314 provide leverage points to torque secondary barrel nut 300. For example, secondary barrel nut 300 can be tightened by inserting a tool, e.g., spanner wrench, into openings 314 to turn the secondary barrel nut. Secondary barrel nut 300 can be made from aluminum, steel, or titanium.

FIG. 6*b* shows internal arrangement of second barrel nut 300, from secondary barrel nut end 302, with internal beveled or tapered surface 316, which will later contact beveled or tapered shoulder 268 upon further assembly.

Figure 6C:
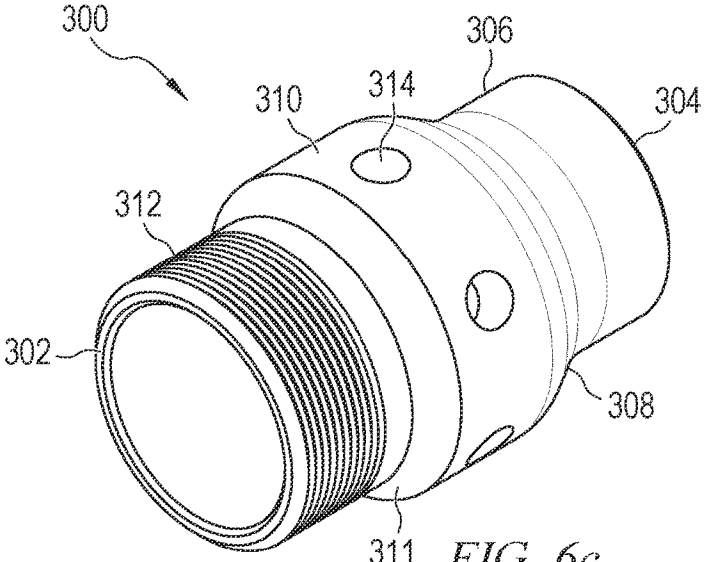

FIG. 6*c* shows a perspective view of second barrel nut 300 from secondary barrel nut end 302 with external male threaded-end 312. Threaded-end 312 will mate with internal female threading 298 of primary barrel nut 280. FIG. 6*d* shows a perspective view of second barrel nut 300 from secondary barrel nut end 304.

Figure 7A:
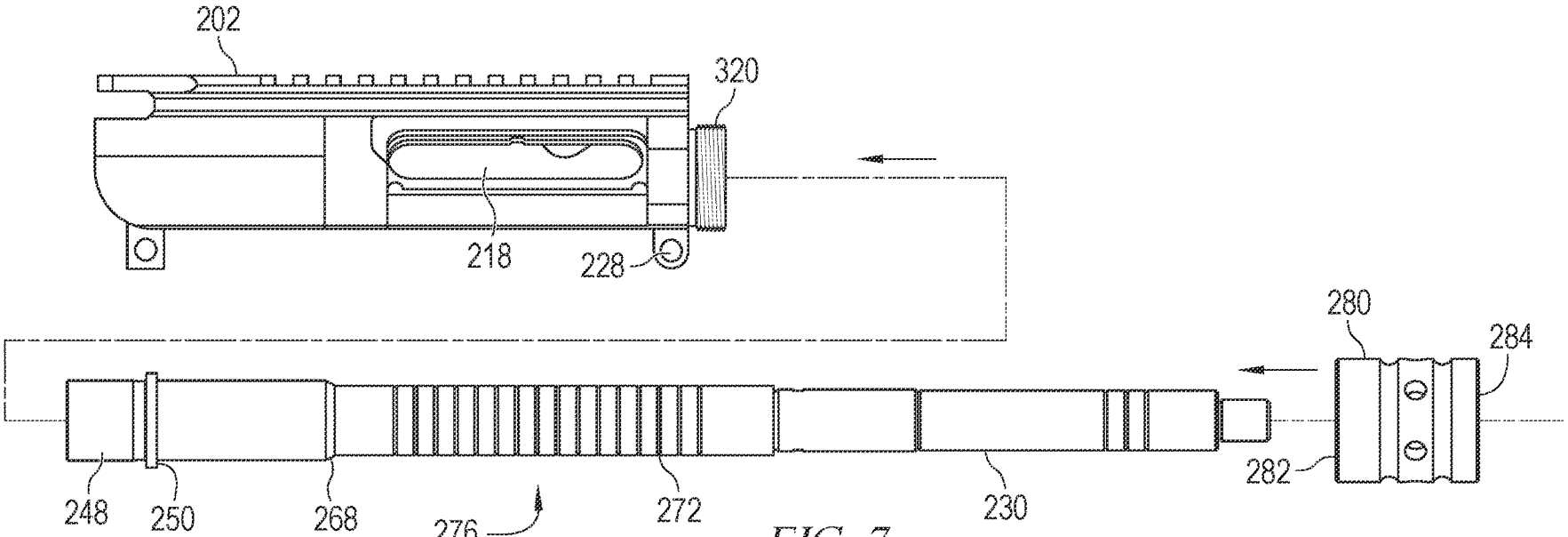
FIGS. 7*a*-7*f* illustrate assembly of the barrel to upper receiver using the primary barrel nut and secondary barrel nut.
Figure 7B:
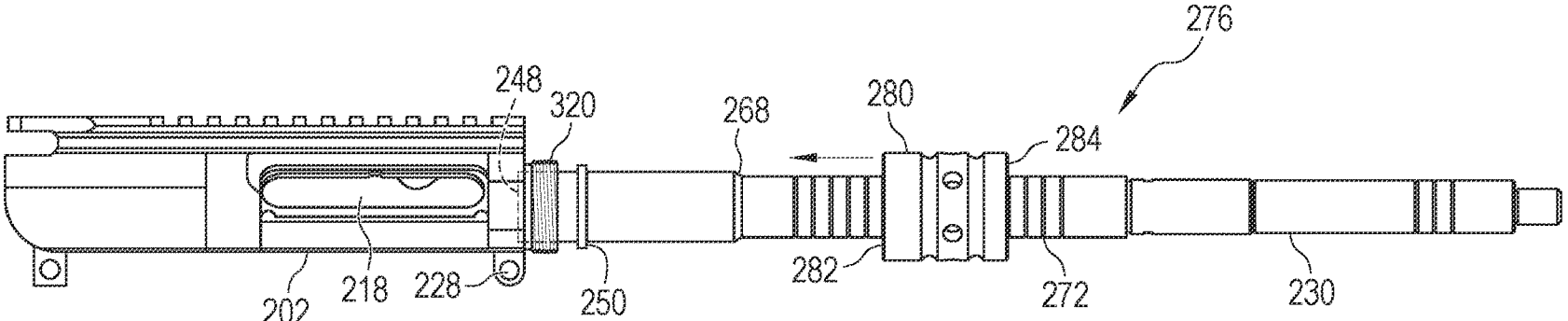
Figure 7C:
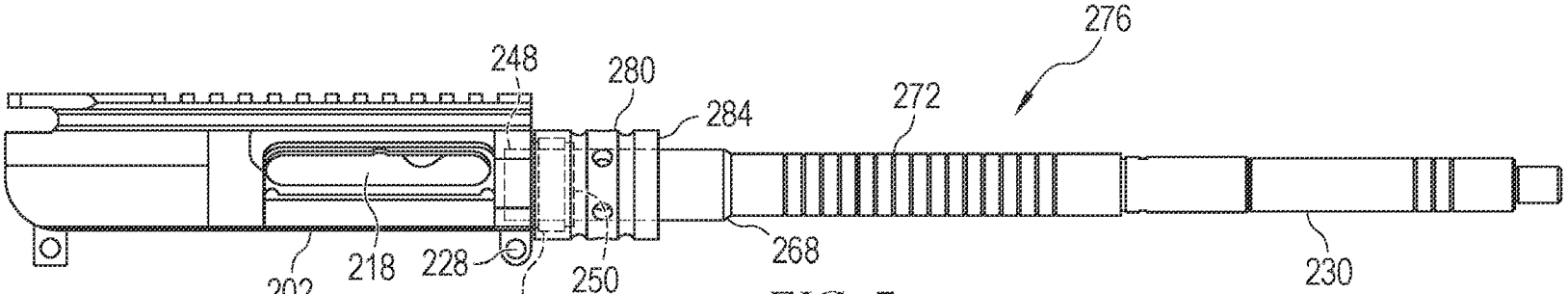

In FIG. 7*a*, barrel assembly 276 and primary barrel nut 280 are disposed for assembly with upper receiver or barrel receiving unit 202. The barrel extension 248 side of barrel assembly 276 is oriented toward upper receiver 202, and primary barrel nut 280 is positioned to slide over barrel 230. In FIG. 7*b*, barrel extension 248 slides into an opening in upper receiver 202 with shoulder 250 remaining outside the upper receiver. Primary barrel nut 280 slides over barrel 230, leading with primary barrel nut end 282. In FIG. 7*c*, primary barrel nut 280 mates with upper receiver 202 by internal female threading 296 screwing onto threading 320 of the upper receiver. In particular, primary barrel nut 280 is tightened by inserting a tool, e.g., spanner wrench, into openings 286 to turn the primary barrel nut. Primary barrel nut 280 rotates until internal shoulder 290 of the primary barrel nut is brought into contact with external shoulder 250 of barrel extension 248. Primary barrel nut 280 initially secures barrel assembly 276 to upper receiver 202.

Figure 7D:
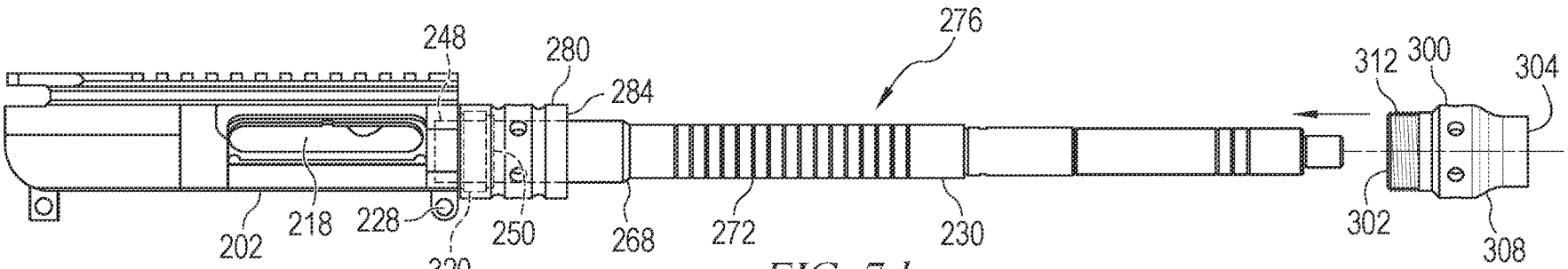
Figure 7E:
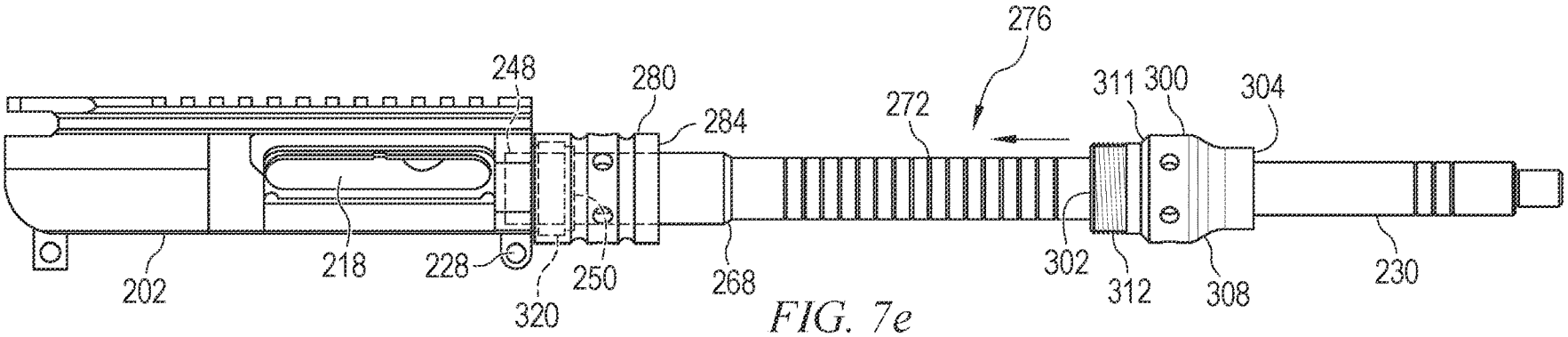
Figure 7F:
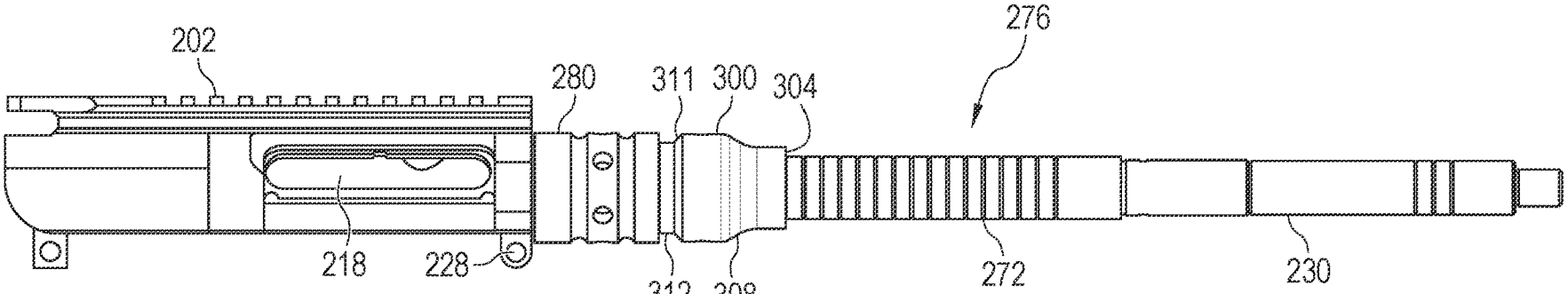

In FIG. 7*d*, secondary barrel nut 300 is disposed for assembly with primary barrel nut 280. External male threading 312 is oriented toward upper receiver 202 and positioned to slide over barrel 230. In FIG. 7*e*, secondary barrel nut 300 slides over barrel 230, leading with secondary barrel nut end 302. In FIG. 7*f*, secondary barrel nut 300 mates with primary barrel nut 280 by external male threading 312 screwing onto internal female threading 298 of the primary barrel nut. In particular, secondary barrel nut 300 is tightened by inserting a tool, e.g., spanner wrench, into openings 314 to turn the secondary barrel nut. Secondary barrel nut 300 rotates until internal beveled or tapered shoulder 316 of the secondary barrel nut is brought into contact with beveled or tapered shoulder 268 of barrel 230.

By nature of internal beveled or tapered shoulder 316 contacting beveled or tapered shoulder 268, barrel 230, and correspondingly bore 242, is centered and aligned with upper receiver 202. Secondary barrel nut 300 is tightened to 54-108 newton meters (nm). Once the barrel alignment is secure, primary barrel nut 280 is tightened to 54-108 nm to lock barrel assembly 276 to upper receiver 202. The proper alignment between upper receiver 202 and bore 242 of barrel 230 avoids wear on the bolt, catastrophic failure of the bolt, and un-torquing of the barrel extension due to vibration and heat expansion. The proper alignment between upper receiver 202 and bore 242 of barrel 230 reduces harmonic vibration, while increase dynamics, durability, and accuracy of sporting rifle 200.

Barrel assembly 278 can also be mated to upper receiver using the double barrel nut 280 and 300 assembly process, similar to FIGS. 7*a*-7*f*. In particular, primary barrel nut 280 rotates until internal beveled or tapered shoulder 292 of the primary barrel nut is brought into contact with external beveled or tapered shoulder 256 of barrel extension 254. Secondary barrel nut 300 rotates until internal beveled or tapered shoulder 316 of the secondary barrel nut is brought into contact with beveled or tapered shoulder 268 of barrel 230.

Figure 8A:
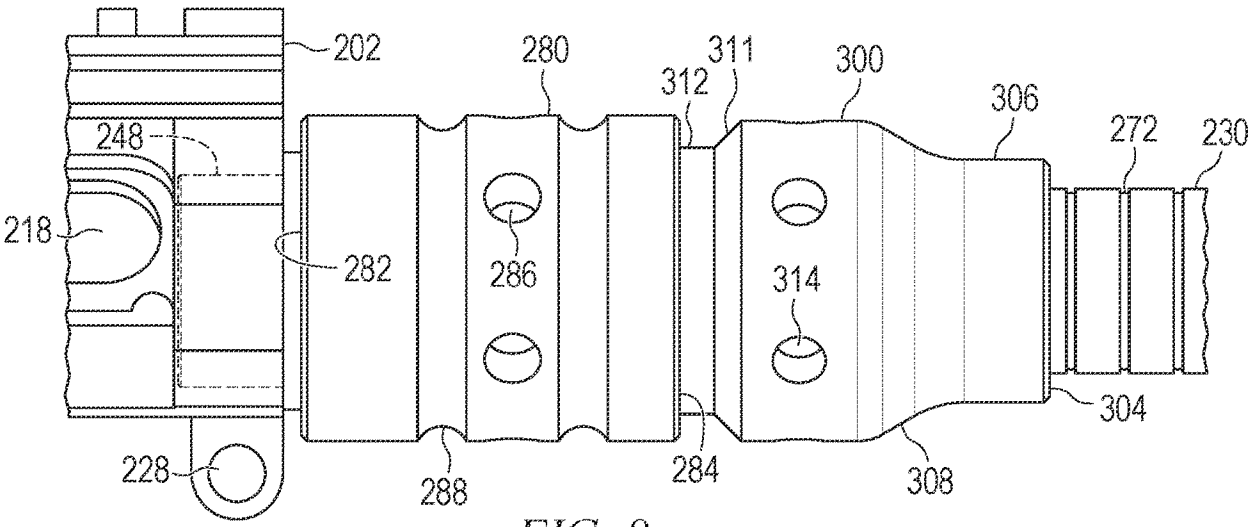
FIGS. 8*a*-8*d* illustrate the barrel mated to upper receiver with the primary barrel nut and secondary barrel nut.
Figure 8B:
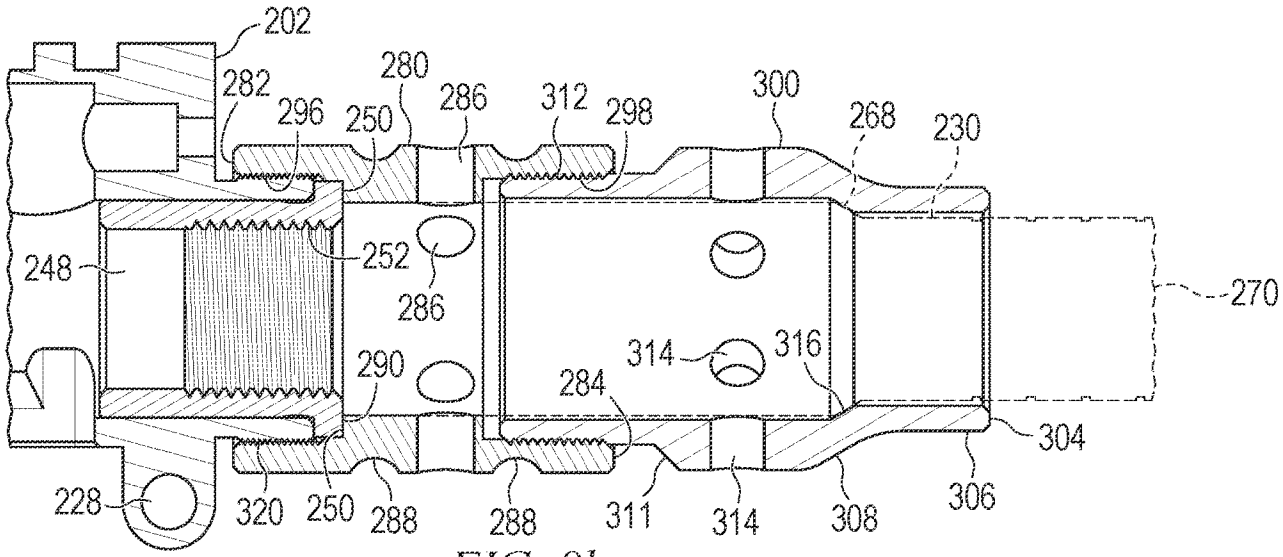

FIG. 8*a* shows further detail of primary barrel nut 280 and secondary barrel nut 300. FIG. 8*b* is an internal view of primary barrel nut 280 and secondary barrel nut 300 with barrel extension 248 and shoulder 250. The flat surface of shoulder 250 contacts the flat surface of shoulder 290. In particular, shoulder 250 is under torqued contact with internal shoulder 290 of primary barrel nut 280. Beveled or tapered shoulder 268 of barrel 230 is under torqued contact with internal beveled or tapered shoulder 316 in secondary barrel nut 300. In one embodiment, beveled or taper shoulder 268 and 316 are formed with an angle of 10-60 degrees.

Figure 8C:
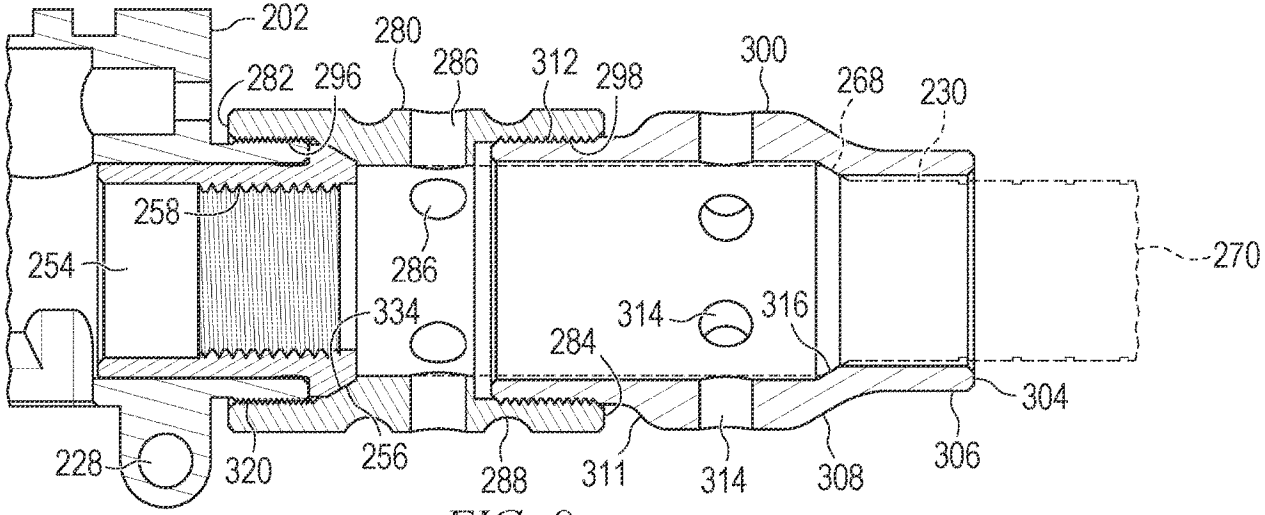

FIG. 8*c* is an internal view of primary barrel nut 280 and secondary barrel nut 300 with barrel extension 254 and beveled or tapered shoulder 256. In particular, beveled or tapered shoulder 256 is under torqued contact with internal shoulder 292 of primary barrel nut 280. Beveled or tapered shoulder 268 of barrel 230 is under torqued contact with internal beveled or tapered shoulder 316 in secondary barrel nut 300. In one embodiment, beveled or taper shoulder 292 and 256 are formed with an angle of 10-60 degrees. Beveled or taper shoulder 268 and 316 are formed with an angle of 10-60 degrees.

Figure 8D:
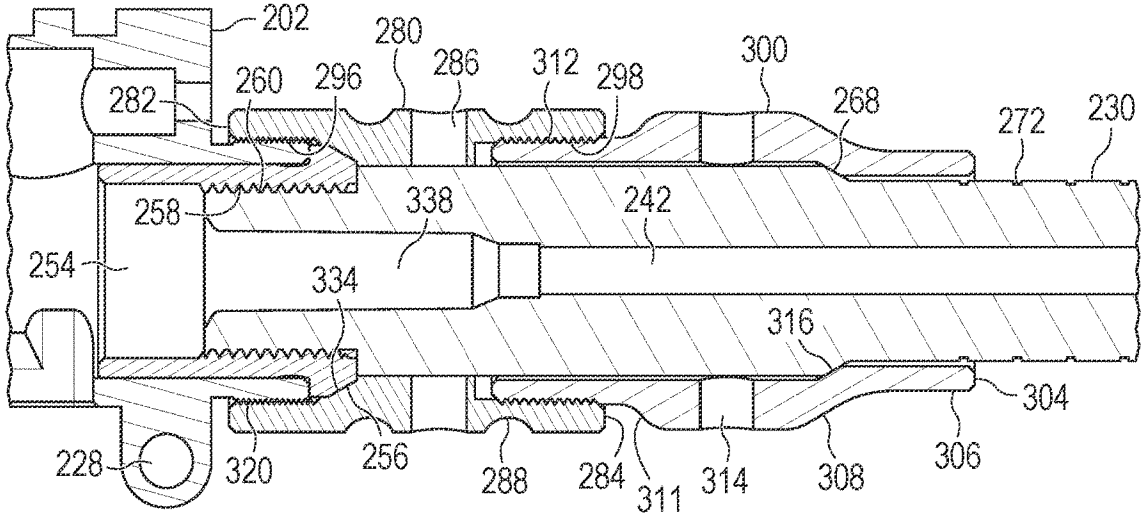
Figure 9:
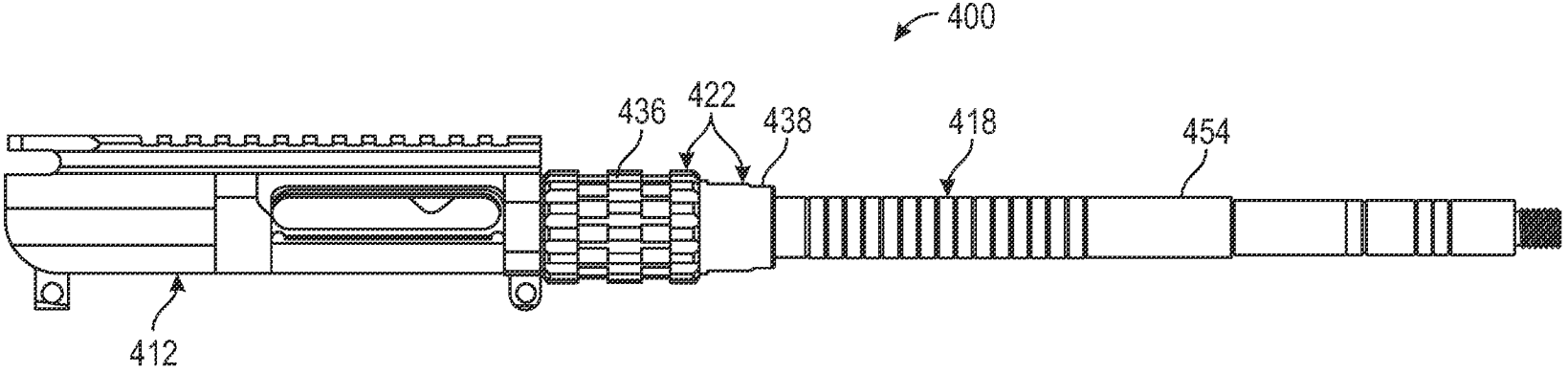
FIG. 9 is a right side view of the current embodiment of a rifle with tapered interfaces constructed in accordance with the principles of the present invention showing the barrel connected to the receiver.
Figure 10:
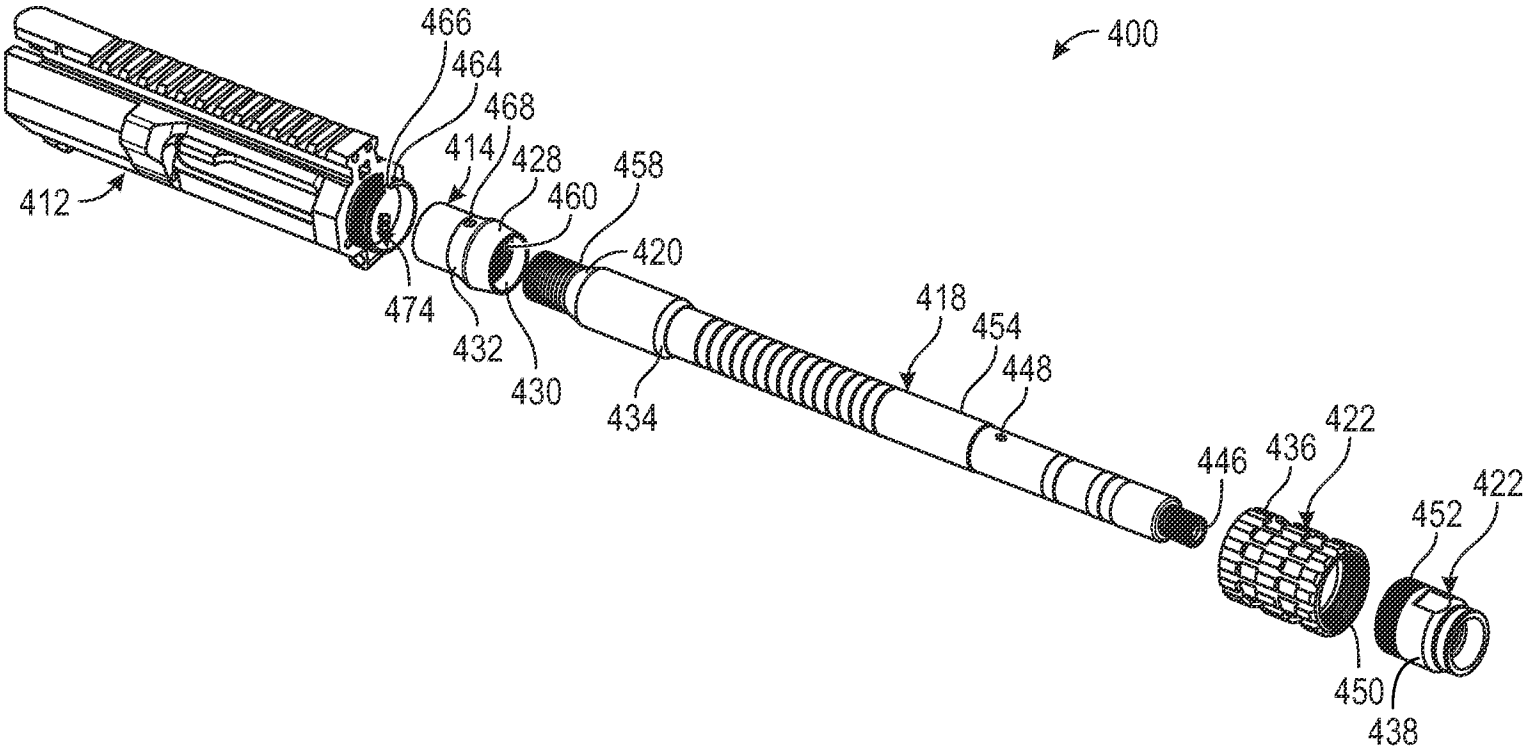
FIG. 10 is an exploded view of the rifle with tapered interfaces of FIG. 9.
Figure 11:
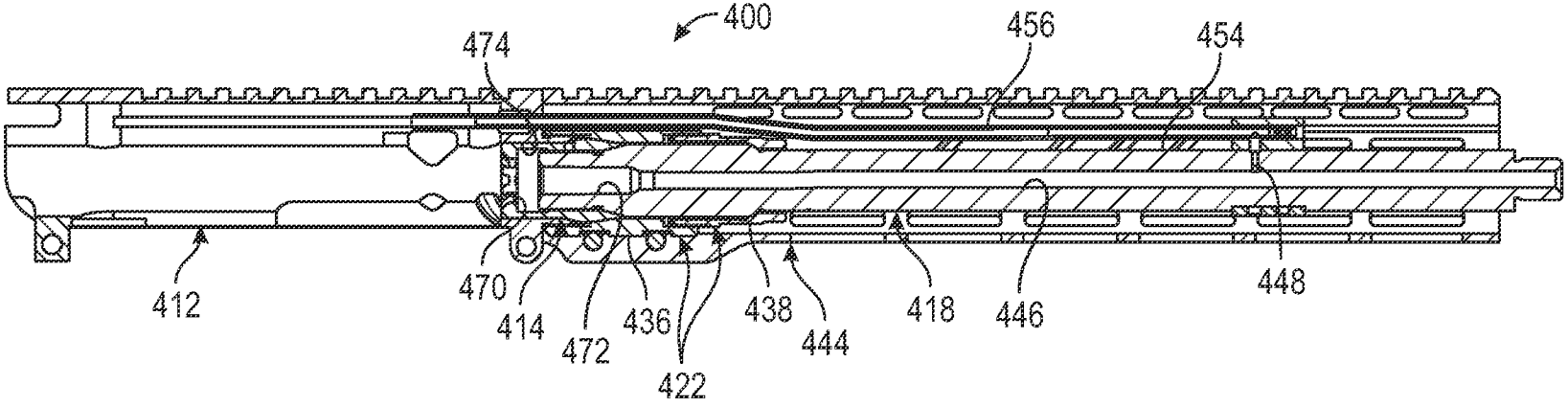
FIG. 11 is a side sectional view of the rifle with tapered interfaces of FIG. 9.
Figure 12:
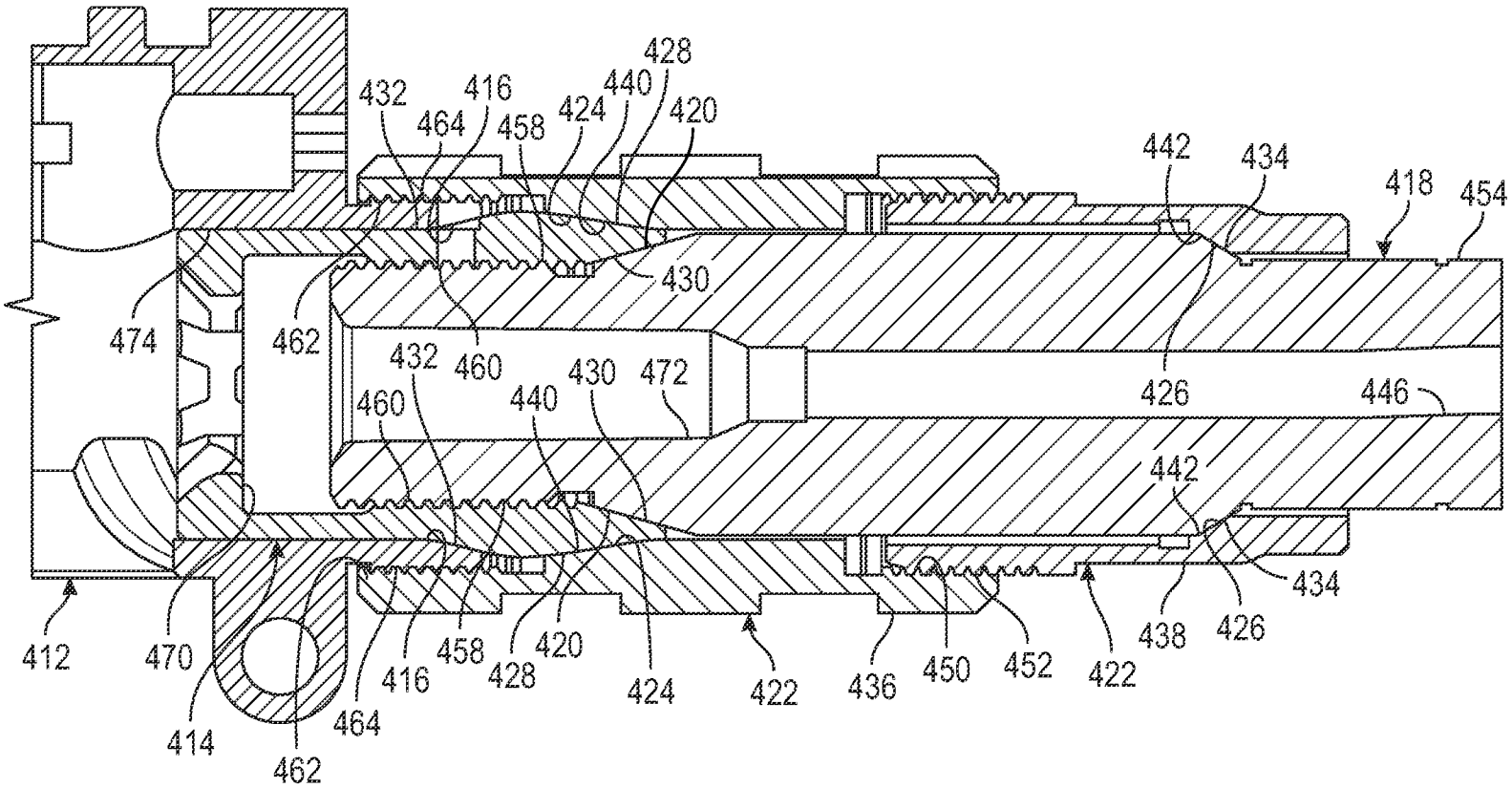
FIG. 12 is an enlarged side sectional view of the rifle with tapered interfaces of FIG. 9.

FIG. 8*d* is a cross-sectional view of primary barrel nut 280 and secondary barrel nut 300 with barrel extension 254 and beveled or tapered shoulder 256. In particular, beveled or tapered shoulder 256 is under torqued contact with internal shoulder 292 of primary barrel nut 280. Beveled or tapered shoulder 268 of barrel 230 is under torqued contact with internal beveled or tapered shoulder 316 in secondary barrel nut 300.

As shown in FIGS. 8*a*-8*d*, by nature of internal beveled or tapered shoulder 316 contacting beveled or tapered shoulder 268, barrel 230, and correspondingly bore 242, is centered and aligned with upper receiver 202. The proper alignment between upper receiver 202 and bore 242 of barrel 230 avoids wear on the bolt, catastrophic failure of the bolt, and un-torquing of the barrel extension due to vibration and heat expansion. The proper alignment between upper receiver 202 and bore 242 of barrel 230 reduces harmonic vibration, while increasing dynamics, durability, and accuracy of sporting rifle 200. The double barrel nut assembly 280, 300 is applicable to most, if not all, firearms with a removeable barrel.

FIGS. 9-12 illustrate the improved rifle with tapered interfaces 400 of the present invention. More particularly, the rifle with tapered interfaces has a receiver 412 with a barrel extension 414 connected to the receiver at a first interface 416. A barrel 418 is connected to the barrel extension at a second interface 420. A barrel nut element 422 is connected to the barrel extension at a third interface 424 and to the barrel at a fourth interface 426. At least two of the first, second, third, and fourth interfaces are tapered interfaces in the current embodiment.

The tapered interfaces are stably tapered such that a wedging effect is generated. The barrel extension 414 has a forward external tapered interface 428 connecting to the barrel nut element and a forward internal tapered interface 430 connecting to the barrel. The barrel extension also has tapered interface 432 connected to the receiver 412. The barrel has an additional tapered interface 434 that contacts the barrel nut element. One of the second interface 420 of the barrel and the additional tapered interface 434 of the barrel is tapered rearward and the other one is tapered forward in the current embodiment.

The barrel nut element 422 includes a rear barrel nut portion 436 and a forward barrel nut portion 438 adjustably connected to each other. The rear and forward barrel nut portions each include a tapered interface 440, 442. One of the tapered interfaces of the rear and forward barrel nut portions interfaces with the barrel extension 414, and the other one of the tapered interfaces of the rear and forward barrel nut portions interfaces with the barrel 418. Only limited torque can be applied to the barrel within the barrel extension to prevent stretching or other deformation that could adversely affect accuracy, making a tapered interface with a portion of the barrel nut element desirable. The forward barrel nut portion, which also serves as a heat sink, is made of copper in the current embodiment. Copper provides eight times better thermal conductivity from contact than aluminum at the tapered interface 426 and prevents the barrel from separating from the receiver from thermal cycles. The receiver and rear barrel nut portion are made of aluminum. The barrel and barrel extension are made of stainless steel. The rear and forward barrel nut portions are threadably engaged to each other by threaded portions 450, 452. The barrel extension has three tapered interfaces 428, 430, 432.

The tapered interfaces have the following preferred, minimum, and maximum angles. A flatter angle less than the minimum angle would provide inadequate wedging, while a steeper angle than the maximum angle would provide excessive wedging. Tapered interface 416 between the barrel extension 414 and the receiver 412: 20° minimum, 25° maximum. Tapered interface 420 between the barrel extension 414 and the barrel 418: 25° minimum, 30° maximum. Tapered interface 424 between the barrel extension and the rear barrel nut portion 436 of the barrel nut element 422: 15° minimum, 18° maximum. Tapered interface 426 between the barrel and the forward barrel nut portion 438 of the barrel nut element: 55° minimum, 65° maximum.

The rifle with tapered interfaces 400 also includes a handguard 444 encircling the barrel 418. The barrel defines a barrel bore 446 and a gas port 448 communicating between the barrel bore and the exterior 454 of the barrel. A gas tube 456 received within the handguard and connected to the receiver 412 communicates between the gas port and the receiver. The barrel and barrel extension 414 are threadably engaged to each other by threaded portions 458, 460. The rear barrel nut portion 436 and the receiver are threadably engaged to each other by threaded portions 462, 464. The threaded portion of the receiver defines a slot 466 that receives a tension pin 468 connected to the barrel extension to prevent rotation of the barrel extension within the receiver.

To assemble the rifle with tapered interfaces 400, first the threaded portion 460 of the barrel extension 414 is screwed onto the threaded portion 458 of the barrel 418 and torqued to 150 ft lb. Second, the head space between the forward facing surface 470 of the barrel extension lugway and the head of a gauge (not shown) in a chamber 472 defined by the barrel is checked. Third, lubricant anti-seize is applied to all tapered interfaces. Fourth, the barrel extension is inserted into a central bore 474 defined by the receiver 412. Fifth, the threaded portion 462 of the rear barrel nut portion 436 of the barrel nut element 422 is screwed onto the threaded portion 464 of the receiver and torqued to 50-55 ft lb. Sixth, the threaded portion 452 of the forward barrel nut portion 438 of the barrel nut element is screwed onto the threaded portion 450 of the rear barrel nut portion and torqued to 45-50 ft lb. The forward barrel nut portion is torqued to 10% less than the rear barrel nut portion to avoid rotating and applying excessive torque to the rear barrel nut portion during installation.

The rifle with tapered interfaces solves the problems associated with the shrink-fit and thermal fit processes by relying on tapered interfaces to mount and secure the barrel 418. Tapers are well-known across industries to be self-centering and excellent mechanical fasteners that guarantee concentricity. Tapers resist movement because tapers necessarily rely on 360° contact and necessarily lack the high/low points that are found on flat shoulders. The thermal expansion of tapered components tends to make the tapered contact tighter and more secure, even in the context of different materials and thermal expansion rates. Therefore, heating of the components of the rifle with tapered interfaces 400 during prolonged firing does not adversely affect accuracy.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While one or more embodiments of a rifle with tapered interfaces has been described in detail, it should be apparent that modifications and variations thereto are possible, all of which fall within the true spirit and scope of the invention. While the embodiments disclose multiple tapered interfaces, it is believed that having any one (or combination) of tapered interfaces with these characteristics can provide benefits for certain applications. Furthermore, although four tapered interfaces have been disclosed, it should be appreciated that at least two tapered interfaces interconnecting at least three of the four of the receiver, barrel extension, barrel nut element, and barrel is sufficient to achieve increased accuracy relative to conventional shrink-fit and thermal fit processes. A conventional vertical shoulder engagement between the rear barrel nut portion and the barrel extension could be used if maximum accuracy is not required, although such engagement is not preferred because thermal changes would create geometry changes. A conventional vertical shoulder engagement between the forward barrel nut portion and the barrel could also be used if maximum accuracy is not required, although such engagement is not preferred because thermal changes would create geometry changes. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A rifle comprising:

a receiver;

a barrel extension connected to the receiver at a first interface;

a barrel connected to the barrel extension at a second interface;

a barrel nut element connected to the barrel extension at a third interface;

the barrel nut element connected to the barrel at a fourth interface; and at least three of the first, second, third, and fourth interfaces being tapered interfaces.

2. The rifle of claim 1 wherein the tapered interfaces are tapered such that a wedging effect is generated.

3. The rifle of claim 1 wherein the barrel extension has two tapered interface surfaces.

4. The rifle of claim 3 wherein the two tapered interface surfaces of the barrel extension include a forward external tapered interface surface and a forward internal tapered interface surface, the forward external tapered interface surface connecting to the barrel nut element at the third interface, and the forward internal tapered interface surface connecting to the barrel at the second interface.

5. The rifle of claim 3 wherein the two tapered interface surfaces of the barrel extension include a forward tapered interface surface and a rear tapered interface surface, the forward tapered interface surface connecting to at least one of the barrel nut element at the third interface and the barrel at the second interface, and the rear tapered interface surface connecting to the receiver at the first interface.

6. The rifle of claim 1 wherein the barrel extension has three tapered interface surfaces, each connected to a respective one of the receiver, the barrel nut element and the barrel.

7. The rifle of claim 1 wherein the barrel has two tapered interface surfaces.

8. The rifle of claim 7 wherein a first one of the barrel tapered interface surfaces contacts the barrel extension and a second one of the barrel tapered interface surfaces contacts the barrel nut element.

9. The rifle of claim 7 wherein one of the barrel tapered interface surfaces is tapered rearward and the other one of the barrel tapered interface surfaces is tapered forward.

10. The rifle of claim 9 wherein the rearward tapered interface surface is rearward of the forward tapered interface surface.

11. The rifle of claim 1 wherein the barrel nut element includes a rear barrel nut portion and a forward barrel nut portion adjustably connected to each other.

12. The rifle of claim 11 wherein the rear barrel nut portion includes a first barrel nut tapered interface surface and the forward barrel nut portions includes a second barrel nut tapered interface surface.

13. The rifle of claim 12 wherein one of the first and the second barrel nut tapered interface surfaces contacts the barrel extension at the third interface, and the other of the first and the second barrel nut tapered interface surfaces contacts the barrel at the fourth interface.

14. The rifle of claim 11 wherein the forward barrel nut portion is copper.

15. The rifle of claim 11 wherein the rear and forward barrel nut portions are threadably engaged to each other.

16. The rifle of claim 1 wherein the barrel extension has three tapered interface surfaces.

* * * * *